US008498380B2

(12) United States Patent
Behling

(10) Patent No.: US 8,498,380 B2
(45) Date of Patent: Jul. 30, 2013

(54) AUXILIARY GRID ELECTRODE FOR X-RAY TUBES

(75) Inventor: Rolf Karl Otto Behling, Norderstedt (DE)

(73) Assignee: Koninklijke Philips N.V., Eindhoven (NL)

( * ) Notice: Subject to any disclaimer, the term of this patent is extended or adjusted under 35 U.S.C. 154(b) by 148 days.

(21) Appl. No.: 13/131,086

(22) PCT Filed: Nov. 23, 2009

(86) PCT No.: PCT/IB2009/055282

§ 371 (c)(1),
(2), (4) Date: May 25, 2011

(87) PCT Pub. No.: WO2010/061332

PCT Pub. Date: Jun. 3, 2010

(65) Prior Publication Data

US 2011/0235785 A1 Sep. 29, 2011

(30) Foreign Application Priority Data

Nov. 26, 2008 (EP) ..... 08169944

(51) Int. Cl.
*H01J 35/14* (2006.01)

(52) U.S. Cl.
USPC ..... 378/138

(58) Field of Classification Search
USPC ..... 378/119, 136–138, 144, 145
See application file for complete search history.

(56) References Cited

U.S. PATENT DOCUMENTS

| | | | | |
|---|---|---|---|---|
| 3,916,202 | A | 10/1975 | Heiting et al. | |
| 5,617,464 | A * | 4/1997 | Mika et al. | 378/137 |
| 5,703,924 | A | 12/1997 | Hell et al. | |
| 5,748,701 | A | 5/1998 | Mika et al. | |
| 2001/0002208 | A1 | 5/2001 | Matsushita et al. | |
| 2006/0008053 | A1 | 1/2006 | Ishikawa et al. | |

FOREIGN PATENT DOCUMENTS

| | | | |
|---|---|---|---|
| DE | 3514700 | A1 | 4/1985 |
| DE | 4230047 | C1 | 9/1992 |
| FR | 2718599 | A1 | 10/1995 |
| GB | 2015245 | A | 9/1979 |

* cited by examiner

*Primary Examiner* — Irakli Kiknadze

(57) ABSTRACT

The present invention refers to an X-ray tube of the rotary-anode type which comprises at least one temporarily negatively biased auxiliary grid electrode (119) with an aperture through which an electron beam (115) emitted by a tube cathode's thermoionic electron emitter (111) can pass. As an alternative thereto, the auxiliary grid electrode (119) may also be positively biased so as to enhance electron emission from a thermoionic electron emitter (111). The auxiliary grid electrode may thereby be connected to a supply voltage $U_{AUX}$ of a controllable voltage supply unit by means of a feedthrough cable (120) serving as a feeding line for providing the main control grid (112) with a grid supply voltage $U_G$.

17 Claims, 4 Drawing Sheets

AUXILIARY GRID ELECTRODE FOR X-RAY TUBES

FIELD OF THE INVENTION

The present invention refers to the field of high-power X-ray sources, in particular to X-ray tubes of the rotary-anode type which can advantageously be applied in the field of material inspection or in the scope of medical X-ray imaging applications. According to the invention, an X-ray tube of the kind mentioned above is disclosed which comprises an at least one temporarily negatively biased auxiliary grid electrode with an aperture through which an electron beam emitted by a tube cathode's thermoionic electron emitter can pass. As an alternative thereto, the auxiliary grid electrode may also be positively biased so as to enhance electron emission from the emitter. The auxiliary grid electrode may thereby be connected to a supply voltage of a controllable voltage supply unit by means of a feedthrough cable serving as a feeding line for providing the main control grid with a grid supply voltage.

BACKGROUND OF THE INVENTION

The electron emission originating from the surface of a thermoionic electron emitter strongly depends on the "pulling" electric field which is usually generated by the X-ray tube's anode. For enabling fast on/off switching, it is known from the relevant prior art that X-ray tubes of the rotary-anode type may be equipped with a grid electrode placed in the vicinity placed in front of the tube cathode's electron emitter. In ancient radio tubes, said grid electrode was realized as a grid of wires. Therefore, this electrode is still called "grid" despite it looks rather aperture-like in modern X-ray tubes and is a part of the electrostatic focusing of the cathode cup. To shut off the electron beam completely, a so-called cut-off voltage $U_{co}$ is applied to the grid electrode which generates a repelling field and is usually given by the absolute value of the potential difference between the electron emitter and the grid electrode. The resulting electric field at the emitter surface is the sum of the grid and the anode generated field. If the total field is repelling on all locations on the electron emitter, electron emission is completely cut off.

SUMMARY OF THE INVENTION

When being equipped with a grid electrode as mentioned above, conventional X-ray tubes are typically faced with a couple of severe problems, which can be summarized as follows:

A first problem consists in the fact that the cut-off voltage at the main control grid of a grid switch cathode needs to be proportional to the tube voltage (the latter being defined as the anode-to-cathode potential difference), which can in some cases, where the tube voltage is comparatively high, not securely be handled with present X-ray tubes and present insulation technology for operating these X-ray tubes. New grid designs are characterized by a large through grip and a large pulling field on the emitter surface for high electron emission. In these cases, a high grid cut-off voltage is needed. Given the high temperatures in the cathode, insulation technology is a very difficult issue. To ensure reliable operation, the grid cut-off voltage needs to be limited. At present, there is a gap between voltage requirements and the available insulation technology.

Under given limitations of designs which take the range of available grid cut-off voltages into account by reduction of the through grip, a second problem is poor electron emission at low tube voltages, such as e.g. needed for vascular imaging applications. On the other hand, high emitter temperatures, applied for compensation, cut down the life time of the thermoionic electron emitter.

Furthermore, severe damages of the X-ray tube caused by vacuum arc discharges originating from the negatively charged cathode surface or from the thermoionic electron emitter may occur. Many vacuum discharges start from the cathode head. If they end at ground potential (which exists on the surface of the tube envelope, herein also referred to as "tube frame"), the high-voltage tube circuit, at least the high-voltage feedthrough cables, is/are being rapidly discharged such that severe damage to the X-ray tube or insulation between the cable lines may occur and trigger even more discharges. If not limited properly, arc discharges may raise the X-ray tube current to several kilo amperes with extremely large energy density at the foot point of the discharge path, which may destroy the electron emitter and/or release particles. Aside therefrom, this may further jeopardize the high voltage stability of the X-ray tube. Furthermore, reflections on the cable may create electromagnetic compatibility (EMC) issues.

In view thereof, it is an object of the present invention to provide an X-ray tube equipped with a grid electrode which overcomes all the problems mentioned above by providing limited grid cut-off voltages and allowing emission enhancement and arc discharge current limitation.

This object is solved by an X-ray tube according to anyone of the accompanying claims. Advantageous aspects of the invention will become evident from the subordinate claims.

As claimed herein, a first aspect of the present invention refers to a high-power X-ray tube of the rotary-anode type, said X-ray tube comprising a rotating anode, a cathode equipped with a thermoionic electron emitter and an at least temporarily negatively biased main control grid arranged in a vacuum envelope (also referred to as "tube frame" or "tube envelope") between the thermoionic electron emitter and the rotating anode, wherein said X-ray tube further comprises a biased aperture auxiliary grid electrode through which an electron beam emitted by the thermoionic electron emitter of the X-ray tube's cathode passes after passing the main control grid and before impinging on a focal spot in a target area of the tube anode's X-ray emitting surface.

A further aspect of the present invention relates to a method for operating a high-power X-ray tube as described above, wherein the electron beam is switched on by supplying the aperture auxiliary grid electrode with an electrode potential which is either close to the voltage potential of the electric field at the space point of its location within the X-ray tube or lies at a more positive voltage potential $U_{Aux}$ so as to enhance cathode emission. For switching this electron beam off, the aperture auxiliary grid electrode is supplied with a negative voltage potential $U_{Aux}$.

The timing of switching the aperture auxiliary grid electrode off by supplying it with a negative voltage potential $U_{Aux}$ such as described above may be synchronized with an application of a negative grid cut-off voltage $U_{co}$ to the X-ray tube's main control grid, said grid cut-off voltage being given by the potential difference between the tube cathode's thermoionic electron emitter and the main control grid. On the other hand, the process of switching the aperture auxiliary grid electrode on by supplying it with a positive voltage potential $U_{Aux}$ may be synchronized with said grid cut-off voltage $U_{co}$ being switched off.

Furthermore, the present invention is directed to an X-ray examination system which comprises an X-ray tube as described above, and finally a software program configured for performing the above-described method when running on a control unit of such an X-ray examination system is proposed.

BRIEF DESCRIPTION OF THE DRAWINGS

Advantageous features, aspects, and advantages of the invention will become evident from the following description, the appended claims and the accompanying drawings. Thereby.

DETAILED DESCRIPTION OF THE PRESENT INVENTION

Figure 1:
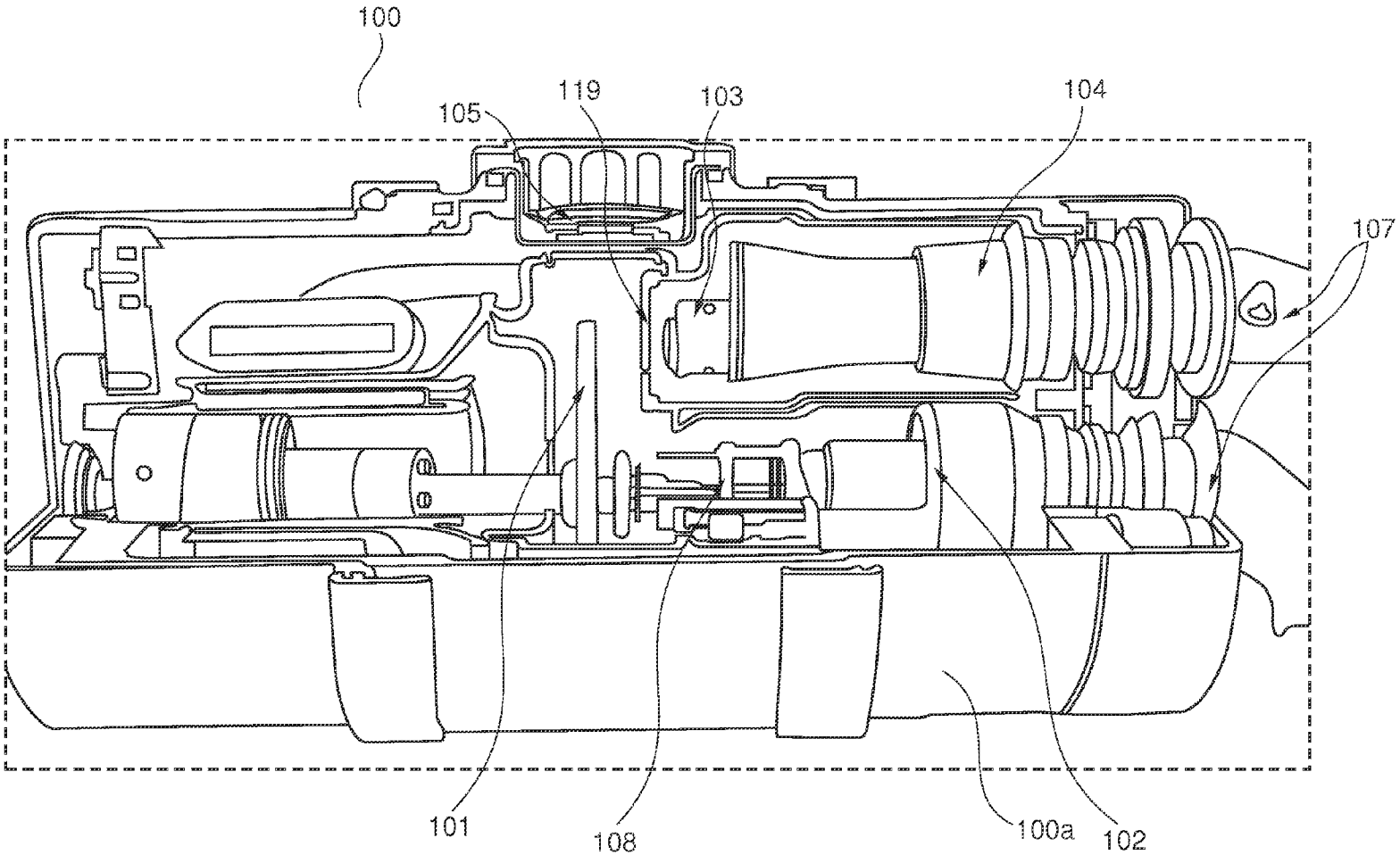
FIG. 1 (Prior Art)
FIG. 1 shows a cut-open 3D view of Philips' SRC 120 0508 X-ray tube as known from the prior art as an X-ray tube of the rotary-anode type.
Figure 2:
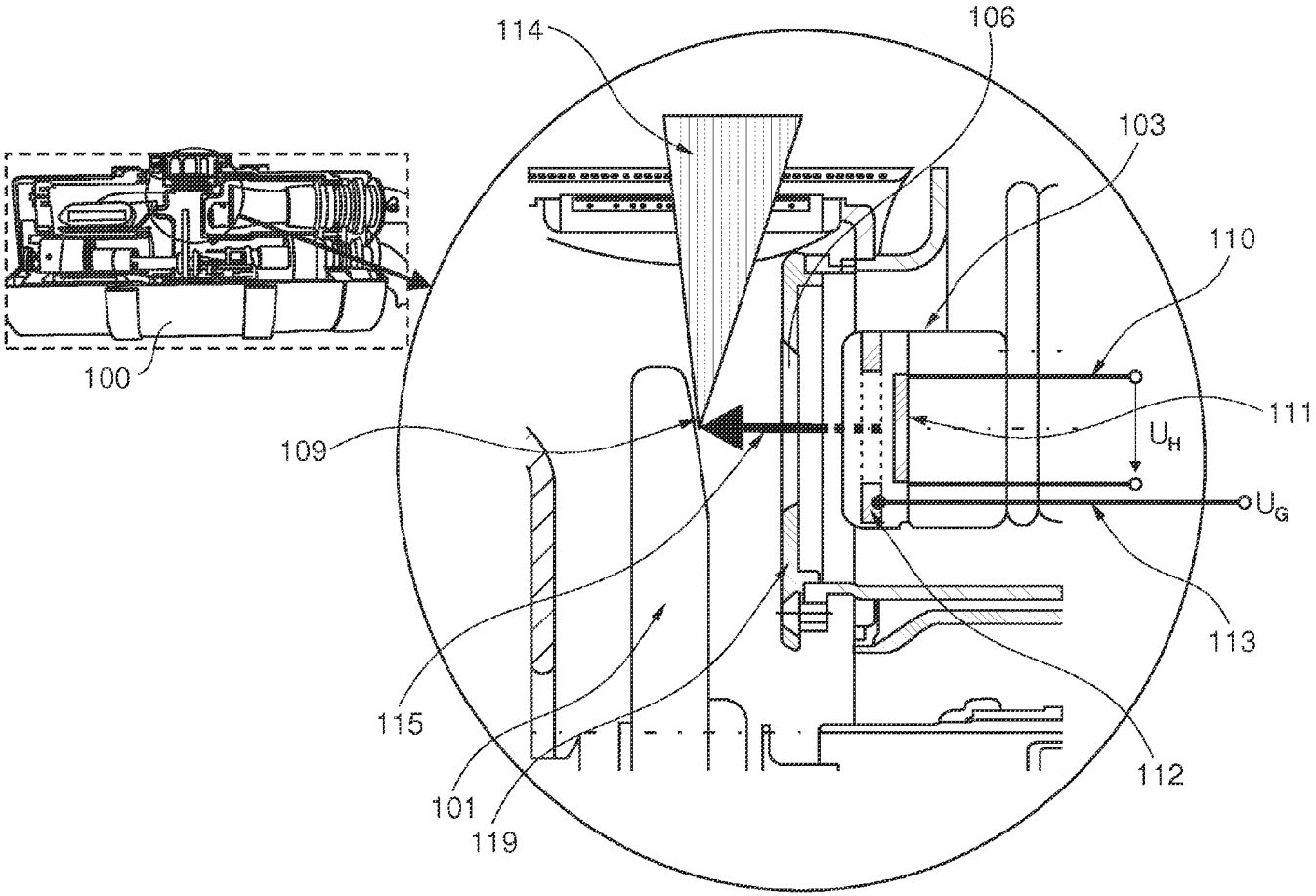
FIG. 2 shows a cross-sectional schematic view of an X-ray tube of the rotary-anode type according to the present invention, which comprises an auxiliary electrode (grid electrode or control grid) realized as a circular plate with an aperture for passing an electron beam emitted by a thermoionic electron emitter placed in front of the tube cathode.
Figure 3:
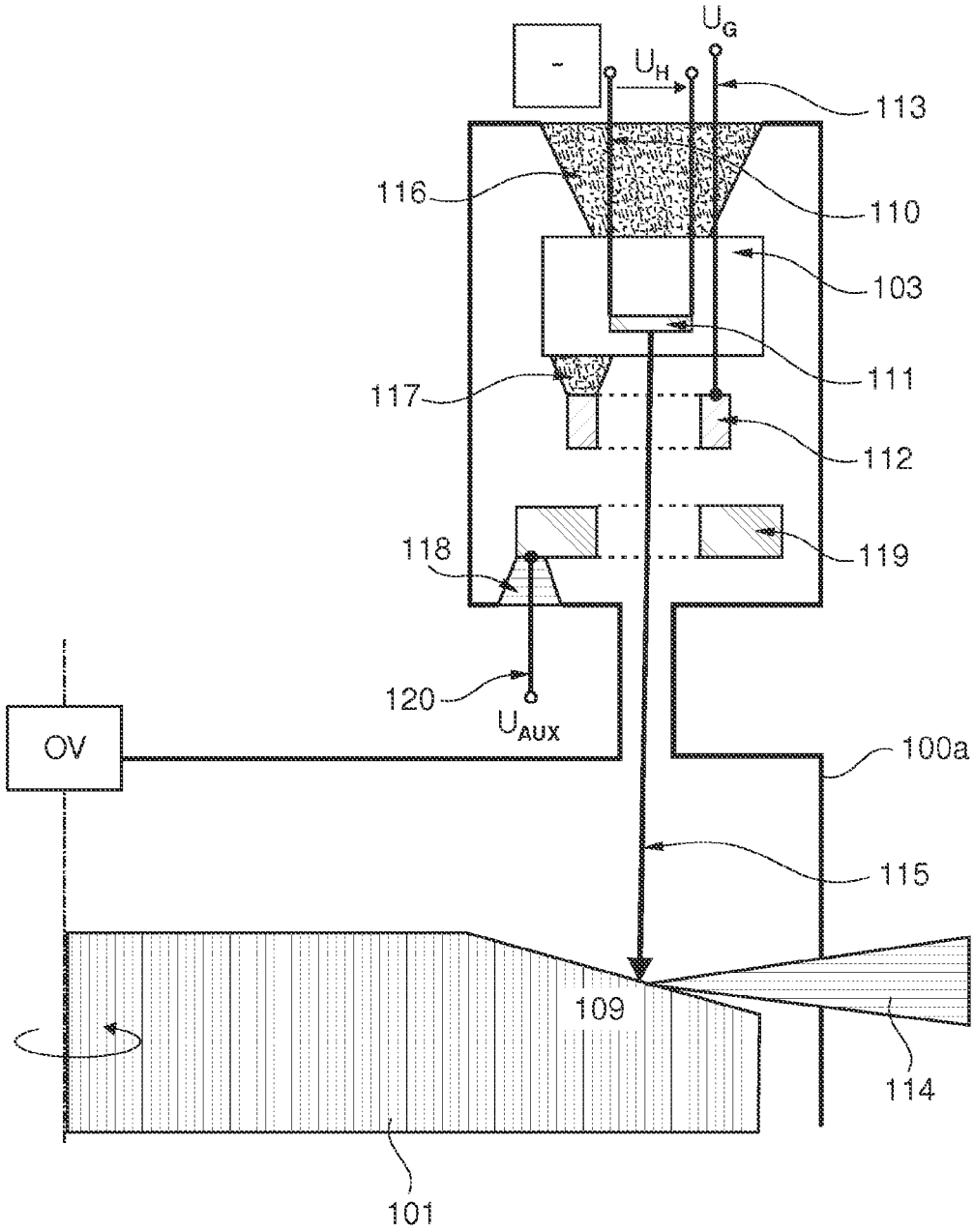
FIG. 3 shows a more detailed cross-sectional view of the embodiment depicted in FIG. 2.
Figure 4:
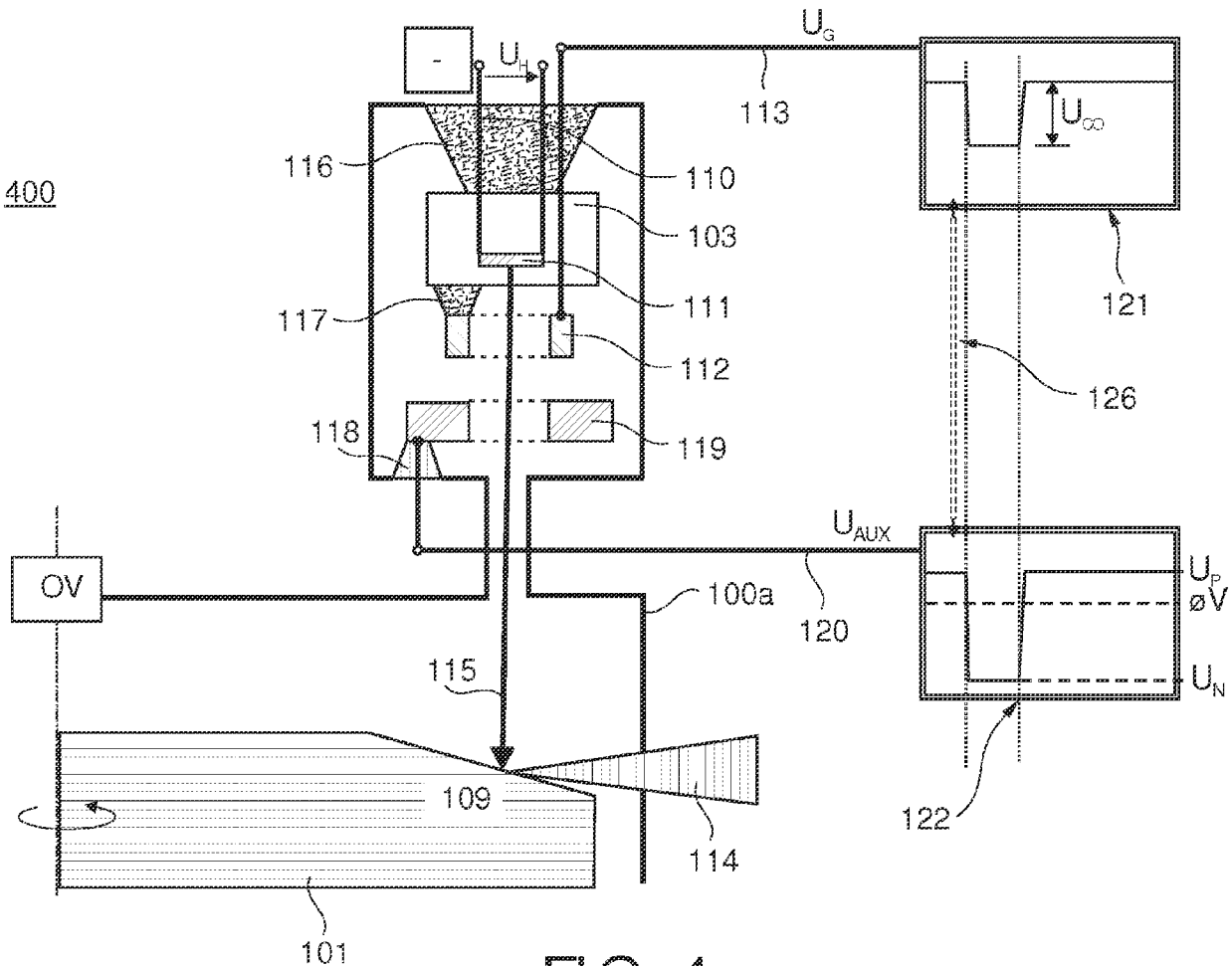
FIG. 4 shows an cross-sectional schematic view of the proposed X-ray tube according to a first exemplary embodiment of the present invention where said auxiliary electrode is connected to a controllable voltage supply, which allows for a secure grid switching and an enhanced electron emission at low tube voltages.

In the following, different embodiments of the present invention will be explained in detail with respect to special refinements and referring to the accompanying drawings.

A first exemplary embodiment of the present invention, which provides for an enhanced grid switching, refers to an X-ray tube of the rotary-anode type, referred to by reference number 100. According to the invention, said tube is equipped with an auxiliary grid electrode 119, placed between the X-ray tube's rotating anode 101 and cathode 103, wherein said auxiliary grid electrode is characterized by an aperture 106 through which an electron beam 115 originating from a thermoionic electron emitter 111 (which may e.g. be realized as a tungsten wire) passes after passing the X-ray tube's main control grid 112 and before impinging on a focal spot 109 in a target area of the tube anode's X-ray emitting surface. In new single-ended tube designs, there is hardly any current of backscattered electrons (scattered from the anode) in the cathode area. The auxiliary grid electrode 119 therefore operates substantially power-less and may be connected to a controllable auxiliary electrode voltage supply 122. For switching electron beam 115 on, electrode potential $U_{Aux}$ of the auxiliary grid electrode 119 may either be set close to the voltage potential of the electric field at the space point of its location (in case such an electrode potential should not already exist) or to a more positive voltage potential so as to enhance cathode emission (particularly at low tube voltages where high emission may be an issue). For switching this electron beam off, auxiliary grid electrode 119 may be supplied with a negative voltage, which may be synchronized with the application of grid cut-off voltage $U_{co}$ to the X-ray tube's main control grid 112, which is placed in front of the thermoionic electron emitter 111 (as seen from the anode).

This implies the advantage that cut-off voltage $U_{co}$ is reduced to values which can be handled with existing insulation technique. Furthermore, high tube emission currents are possible at low tube voltage, which allows for good image quality, and finally a further benefit consists in the fact that auxiliary grid electrode 119 reduces arcing from the cathode 103.

A second exemplary embodiment of the present invention refers to an X-ray examination system (such as e.g. implemented in an X-ray, CT or 3DRA device) which comprises an X-ray tube of the rotary-anode type as described above with reference to said first exemplary embodiment.

Applications of the Present Invention

As already mentioned above, the invention can advantageously be applied in the field of material inspection or in the scope of medical X-ray imaging applications with high-standard and high-security requirements as concerns grid switching, electron emission and discharge current limitation.

While the present invention has been illustrated and described in detail in the drawings and in the foregoing description, such illustration and description are to be considered illustrative or exemplary and not restrictive, which means that the invention is not limited to the disclosed embodiments. Other variations to the disclosed embodiments can be understood and effected by those skilled in the art in practicing the claimed invention, from a study of the drawings, the disclosure and the appended claims. In the claims, the word "comprising" does not exclude other elements or steps, and the indefinite article "a" or "an" does not exclude a plurality. Furthermore, any reference signs contained in the claims should not be construed as limiting the scope of the invention.

TABLE OF USED REFERENCE NUMBERS AND THEIR MEANINGS:

| | |
|---|---|
| 100 | Rotary-anode type X-ray tube |
| 100a | Tube frame (vacuum envelope) |
| 101 | Rotating anode (anode voltage potential: e.g. $U_A = +75$ kV) |
| 102 | Anode insulator |
| 103 | Cathode (cathode voltage potential: e.g. $U_C = -75$ kV) |
| 104 | Cathode insulator |
| 105 | X-ray port |
| 106 | Electron aperture of auxiliary grid electrode 119 |
| 107 | High-voltage cables (i.e., heating current feed 110 and grid voltage feed 113) |
| 108 | Ball bearing system |
| 109 | Focal spot |
| 110 | Heating current feedthrough line |
| 111 | Thermoionic electron emitter (e.g. tungsten wire) |
| 112 | Main control grid, at least temporarily negatively biased ($U_G < 0$) |
| 113 | Grid voltage feedthrough line |
| 114 | X-rays |
| 115 | Electron beam |
| 116 | High-voltage insulator |
| 117 | Grid insulator |
| 118 | Insulator |
| 119 | Single-aperture auxiliary grid electrode (e.g. realized as a large circular plate with a hole) which may e.g. be negatively biased ($U_{Aux} < 0$) |
| 120 | Auxiliary voltage potential feedthrough |
| 121 | Grid voltage supply |
| 122 | Auxiliary electrode voltage supply |
| 126 | Synchronization |
| 400 | Embodiment "Grid switching and emission enhancement" |
| $U_A$ | Anode voltage potential (positive) |
| $U_{co}$ | Grid cut-off voltage ($U_{co} = \lvert U_H - U_G \rvert$ with $U_H = U_C$) |
| $U_{Aux}$ | Voltage potential of the auxiliary grid electrode 119 (negative), for example<br>$U_{Aux} = 0$ kV (electron beam on, high electric field strength): large emission at low $U_C$,<br>$U_{Aux} \approx -15$ kV: regular operation at elevated $U_C$,<br>$U_{Aux} = -30$ kV: electron beam cut off, pulse operation |
| $U_C$ | Cathode voltage potential (negative), for example<br>$U_C = -60$ kV: enhanced emission and emitter life,<br>$U_C = -90$ kV: enhanced emission and emitter life,<br>$U_C = -125$ kV (= minimum value): cut-off problem solved |
| $U_G$ | Voltage potential of main control grid 112: |

-continued

| TABLE OF USED REFERENCE NUMBERS AND THEIR MEANINGS: | |
|---|---|
| | e.g. $U_G = -6$ kV (reduced from −12 kV) |
| $U_H$ | Heating voltage of thermoionic electron emitter 111 (identical with cathode voltage potential $U_C$) |
| $U_N$ | Negative minimum value of auxiliary voltage potential $U_{Aux}$, helps to cut off the tube current |
| $U_P$ | Positive maximum value of auxiliary voltage potential $U_{Aux}$, used for achieving an enhanced cathode emission |

The invention claimed is:

1. An X-ray tube of the rotary-anode type, comprising:

a rotating anode having an X-ray emitting surface comprising a target area that includes a focal spot;

a cathode comprising a thermionic electron emitter; and an at least temporarily negatively biased main control grid arranged in a vacuum envelope between said emitter and said anode, said X-ray tube further comprising a biased aperture auxiliary grid electrode through which an electron beam emitted by said emitter passes after passing a main control grid and before impinging on said focal spot, said X-ray tube configured for switching said auxiliary grid electrode off by supplying said auxiliary grid electrode with a negative voltage potential, for applying a negative grid cut-off voltage to said main control grid, and for synchronizing said switching with said applying, said grid cut-off voltage being given by a potential difference between said emitter and said main control grid and being more negative than said negative voltage potential.

2. The high-power X-ray tube of claim 1, said X-ray tube configured for switching on said electron beam by supplying said auxiliary grid electrode with an electrode potential which is either close to the voltage potential of the electric field at the space point of its location within the X-ray tube, or lies at a more positive voltage potential so as to enhance cathode emission.

3. The X-ray tube according to claim 2, configured for switching off said electron beam by supplying said auxiliary grid electrode with a negative voltage potential.

4. The X-ray tube according to claim 3, configured such that switching said auxiliary grid electrode on by supplying it with a positive voltage potential is synchronized with said grid cut-off voltage being switched off.

5. An X-ray examination system comprising an X-ray tube according to claim 1.

6. The system of claim 5, implemented as a computed tomography (CT) system.

7. The system of claim 5, implemented as a three-dimensional rotational angiography (3DRA) system.

8. The X-ray tube claim 1, configured as a high-power X-ray tube.

9. The X-ray tube according to claim 1, configured for switching off said electron beam by supplying said auxiliary grid electrode with a negative voltage potential.

10. The X-ray tube according to claim 1, configured such that switching said auxiliary grid electrode on by supplying it with a positive voltage potential is synchronized with said grid cut-off voltage being switched off.

11. A non-transitory computer readable medium for an X-ray tube of the rotary-anode type, said X-ray tube comprising:

a rotating anode having an X-ray emitting surface comprising a target area that includes a focal spot;

a cathode comprising a thermionic electron emitter; and an at least temporarily negatively biased main control grid arranged in a vacuum envelope between said emitter and said anode, said X-ray tube further comprising a biased aperture auxiliary grid electrode through which an electron beam emitted by said emitter passes after passing a main control grid and before impinging on said focal spot, said medium embodying a computer program having instructions executable by a processor for performing a plurality of acts, said plurality comprising the acts of:

switching said auxiliary grid electrode off by supplying said auxiliary grid electrode with a negative voltage potential; and applying a negative grid cut-off voltage to said main control grid, said switching being synchronized with said applying, said grid cut-off voltage being given by a potential difference between said emitter and said main control grid and being more negative than said negative voltage potential.

12. The computer readable medium of claim 11, said plurality comprising the act of:

switching on said electron beam by supplying said auxiliary grid electrode with an electrode potential which is either close to the voltage potential of the electric field at the space point of its location within the X-ray tube, or lies at a more positive voltage potential so as to enhance cathode emission.

13. The computer readable medium of claim 12, said plurality comprising the act of:

switching off the electron beam by supplying said auxiliary grid electrode with a negative voltage potential.

14. The computer readable medium of claim 13, switching said auxiliary grid electrode on by supplying it with a positive voltage potential being synchronized with said grid cut-off voltage being switched off.

15. The computer readable medium of claim 11, said plurality comprising the act of:

switching off the electron beam by supplying said auxiliary grid electrode with a negative voltage potential.

16. The computer readable medium of claim 11, switching said auxiliary grid electrode on by supplying it with a positive voltage potential being synchronized with said grid cut-off voltage being switched off.

17. The computer readable medium of claim 11, said X-ray tube being a high-power X-ray tube.

* * * * *